US008459969B2

(12) United States Patent
Matsukuma

(10) Patent No.: US 8,459,969 B2
(45) Date of Patent: Jun. 11, 2013

(54) SCREW FLUID MACHINE

(75) Inventor: Masaki Matsukuma, Kako-gun (JP)

(73) Assignee: Kobe Steel, Ltd., Kobe-shi (JP)

( * ) Notice: Subject to any disclaimer, the term of this patent is extended or adjusted under 35 U.S.C. 154(b) by 539 days.

(21) Appl. No.: 12/682,299

(22) PCT Filed: Oct. 14, 2008

(86) PCT No.: PCT/JP2008/068563

§ 371 (c)(1),
(2), (4) Date: Apr. 9, 2010

(87) PCT Pub. No.: WO2009/054285

PCT Pub. Date: Apr. 30, 2009

(65) Prior Publication Data

US 2010/0209279 A1 Aug. 19, 2010

(30) Foreign Application Priority Data

Oct. 22, 2007 (JP) ..... 2007-273958

(51) Int. Cl.

| | |
|---|---|
| ***F04C 23/00*** | (2006.01) |
| ***F04C 18/00*** | (2006.01) |
| ***F01C 1/16*** | (2006.01) |
| ***F01C 1/24*** | (2006.01) |
| ***F03C 2/00*** | (2006.01) |
| ***F03C 4/00*** | (2006.01) |

(52) U.S. Cl.
USPC ..... 418/9; 418/201.1; 418/203

(58) Field of Classification Search
USPC ..... 418/201.1, 203; 417/366, 410.4
See application file for complete search history.

(56) References Cited

U.S. PATENT DOCUMENTS

| | | | | |
|---|---|---|---|---|
| 3,388,854 | A | 6/1968 | Olofsson et al. | |
| 3,947,163 | A * | 3/1976 | Olofsson | 418/203 |
| 5,135,374 | A * | 8/1992 | Yoshimura et al. | 418/201.2 |
| 5,281,115 | A * | 1/1994 | Timuska | 418/9 |

(Continued)

FOREIGN PATENT DOCUMENTS

| | | |
|---|---|---|
| JP | 48 33041 | 10/1973 |
| JP | 62-7902 | 1/1987 |

(Continued)

OTHER PUBLICATIONS

Office Action issued Jun. 29, 2011 in Korea Application No. 10-2008-92978 (With English Translation).

(Continued)

*Primary Examiner* — Kenneth Bomberg
*Assistant Examiner* — Deming Wan
(74) *Attorney, Agent, or Firm* — Oblon, Spivak, McClelland, Maier & Neustadt, L.L.P.

(57) ABSTRACT

A screw compressor has a balance bearing whose outer ring is movable relative to the casing. A balance piston divides a balance cylinder into a high pressure fluid chamber and a low pressure fluid chamber, and movement of the piston in the balance cylinder is transmitted to the outer ring of the balance bearing. The high pressure fluid chamber and the low pressure fluid chamber are arranged such that higher pressure fluid in the high pressure fluid chamber urges the piston to press the outer ring of the balance bearing oppositely to a spring and toward the main thrust bearing, and lower pressure fluid in the low pressure fluid chamber urges the piston to press the outer ring of the balance bearing away from the main thrust bearing.

5 Claims, 1 Drawing Sheet

U.S. PATENT DOCUMENTS

| | | | | |
|---|---|---|---|---|
| 5,707,223 | A * | 1/1998 | Englund et al. | 418/1 |
| 6,050,797 | A * | 4/2000 | Zhong | 418/203 |
| 2002/0044876 | A1 | 4/2002 | Yoshimura | |
| 2004/0195055 | A1* | 10/2004 | Gilles | 188/73.1 |
| 2007/0272690 | A1* | 11/2007 | Fuchs et al. | 220/203.26 |
| 2009/0095363 | A1* | 4/2009 | Nakakubo et al. | 137/843 |

FOREIGN PATENT DOCUMENTS

| | | |
|---|---|---|
| JP | 62 7902 | 1/1987 |
| JP | 4-129894 | 11/1992 |
| JP | 4 129894 | 11/1992 |
| JP | 11 351169 | 12/1999 |
| JP | 2002 188586 | 7/2002 |
| JP | 2002 317782 | 10/2002 |
| JP | 2004 339994 | 12/2004 |
| JP | 3766725 | 2/2006 |
| KR | 10-0317759 | 12/2001 |

OTHER PUBLICATIONS

Office Action issued Nov. 15, 2011, in Japanese Patent Application No. 2007-273958 (with English-Language Translation).

* cited by examiner

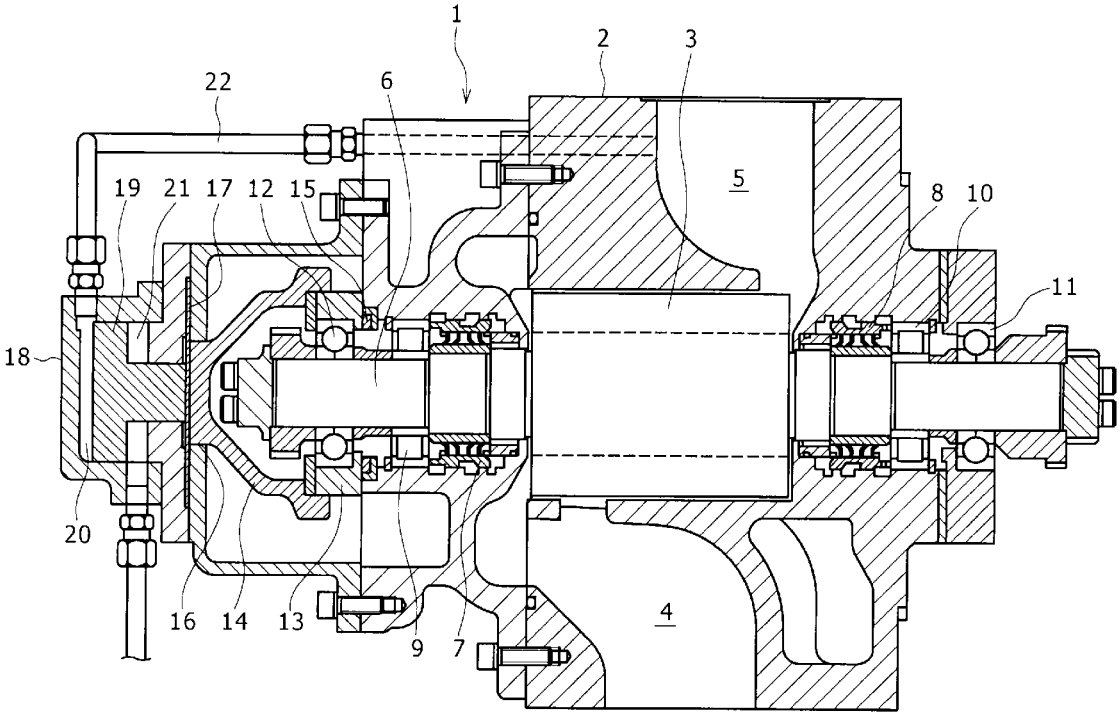
1
2
3
22
6
5
19
21
17
12
15
8
10
11
18
20
16
14
13
9
7
4

SCREW FLUID MACHINE

TECHNICAL FIELD

The present invention relates to a screw fluid machine.

BACKGROUND ART

In a screw fluid machine for compressing and expanding a fluid by male and female screw rotors meshed with each other, for example in a screw compressor for compressing the fluid by the screw rotors, pressure of the compressed fluid generates a thrust load of pressing the screw rotors toward the suction side in the axial direction. A conventional screw compressor has a problem that in a case where discharge pressure is increased, the life of a thrust bearing for receiving this thrust load is shortened.

Even when a plurality of thrust bearings is provided for a rotor shaft, the load is actually concentrated onto one of the thrust bearings. Thus, the life of the thrust bearing cannot be extended.

Patent Documents 1 to 3 describe the invention in which, in order to reduce loading of a thrust bearing of a screw compressor, a piston fitted to a cylinder is provided at an end of a rotor shaft on the suction side and the rotor shaft is pressed in the direction opposite to a thrust load by pressure of a fluid introduced into the cylinder.

However, the piston of each of the screw compressors is rotated together with the rotor shaft inside the cylinder. Thus, there is a problem that friction between the piston and the cylinder or viscous resistance of the fluid in the cylinder increases a rotational load of the rotor shaft so as to lower energy efficiency. There is also a possibility of causing a fault that a seal between the piston and the cylinder is worn away, so that the pressure fluid in the cylinder is leaked out.

[Patent Document 1] Japanese Patent Laid-Open No. 2002-317782

[Patent Document 2] Japanese Patent Laid-Open No. 2004-339994

[Patent Document 3] Japanese Patent No. 3766725

DISCLOSURE OF THE INVENTION

Problems to be Solved by the Invention

In consideration of the above problems, an object of the present invention is to provide a screw fluid machine capable of reducing a thrust load of a rotor shaft, and eliminating risks of an increase in a rotational load by a balance piston and seal leakage of the balance piston.

Means for Solving the Problems

In order to achieve the above object, a screw fluid machine according to the present invention includes a casing; a pair of male and female screw rotor meshed with each other and rotatably accommodated in the casing, the screw rotors being adapted to suction, compress or expand, and discharge a fluid; a main thrust bearing having an inner ring fixed to a rotor shaft serving as a rotation shaft of at least one of the screw rotors and an outer ring fixed to the casing, the main thrust bearing being adapted to receive thrust force of the rotor shaft; a balance bearing having an inner ring fixed to the rotor shaft and an outer ring movable relative to the casing; a bearing holding member for holding the outer ring of the balance bearing; and fluid pressure application means for pressing the bearing holding member along the axial direction of the rotor shaft by fluid pressure.

According to this arrangement, the balance bearing for pressing the rotor shaft by the fluid pressure is provided but not fixed to the casing. Thus, even when the casing and the rotor shaft have size displacement, the thrust load can be distributed onto the main thrust bearing and the balance bearing. Therefore, the life of the bearings is long. In addition, there is no need for a piston rotated together with the rotor shaft. Thus, there is no rotational resistance of the piston, and a low risk of the seal leakage of the fluid pressure offsetting the thrust load.

In the screw fluid machine of the present invention, the balance bearing may be provided on the suction side of the rotor shaft in a screw compressor, and on the discharge side of the rotor shaft in a screw expander.

According to this arrangement, as seen from the screw rotors, the balance bearing and the fluid pressure application means are arranged on the opposite side of an electric motor such as a motor and a turbine in the screw compressor, and the opposite side of a loading device such as a generator in the screw expander. Thus, a space in which the fluid pressure application means and the like are arranged is easily ensured, so that the screw fluid machine is not enlarged.

In the screw fluid machine of the present invention, the fluid pressure may be pressure of the fluid discharged by the screw rotors in the screw compressor, and pressure of the fluid suctioned by the screw rotors in the screw expander.

According to this arrangement, when the fluid pressure on the higher pressure side of the suction side or the discharge side is increased, the thrust load applied on the balance bearing is increased. Thus, the loading on the main thrust bearing can be stabilized, so that the life of the main thrust bearing is extended.

In the screw fluid machine of the present invention, the fluid pressure application means may include a balance piston fitted to a balance cylinder arranged on an extension of the rotor shaft on the suction side in the screw compressor or on an extension of the rotor shaft on the discharge side in the screw expander, and a pressure transmission member connecting the balance piston and the bearing holding member.

According to this arrangement, the balance piston is provided on the same axis as the rotor shaft. Thus, the fluid pressure can be applied on the balance piston precisely in the axial direction.

In the screw fluid machine of the present invention, closed spaces may be formed in the balance cylinder on the suction side and the discharge side of the screw rotors relative to the balance piston respectively, so that different fluid pressures are applied on the suction side and the discharge side of the balance piston respectively.

According to this arrangement, when the fluid pressure on the suction side of the screw rotors and the fluid pressure on the discharge side are applied respectively on both sides of the balance piston, a proper load can be distributed onto the balance bearing in accordance with the thrust load actually applied on the screw rotors.

Effect of the Invention

According to the present invention, since the balance bearing for pressing by the fluid pressure is provided as not fixed to the casing, the thrust load can be distributed onto the main thrust bearing and the balance bearing, so that the life of the bearings is long and the risk of the seal leakage of the fluid pressure is low.

BRIEF DESCRIPTION OF THE DRAWINGS

[FIG. 1] A sectional view of a screw compressor according to one embodiment of the present invention.

EXPLANATION OF REFERENCE NUMERALS

1: Screw compressor (screw fluid machine)
2: Casing
3: Screw rotor
4: Suction port
5: Discharge port
6: Rotor shaft
11: Main thrust bearing
12: Balance bearing
13: Bearing holding member
14: Pressure transmission member
18: Balance cylinder
19: Balance piston
20: High pressure fluid chamber
21: Low pressure fluid chamber

Best Modes for Carrying out the Invention

Now, an embodiment of the present invention will be described with reference to the drawings.

FIG. 1 shows a section of a screw compressor 1 serving as one embodiment of a screw fluid machine of the present invention. In the screw compressor 1, a pair of male and female screw rotor 3 meshed with each other (only the male rotor is shown in the figure) is rotatably accommodated inside a casing 2, a fluid is suctioned from a suction port 4 and compressed by rotation of the screw rotors 3, and the compressed fluid is discharged from a discharge port 5.

A rotor shaft 6 serving as a rotation shaft of the screw rotor 3 is provided, on both the sides of the screw rotor 3, with seal members 7, 8 for sealing gaps between the rotor shaft 6 and the casing 2, and radial bearings 9, 10 for receiving a radial load respectively. In order to receive a thrust load, a main thrust bearing 11 is provided on the discharge side of the rotor shaft 6, and a balance bearing 12 is provided on the suction side thereof. The rotor shaft 6 is connected with a motor (not shown) via a coupling (not shown) at an end of the rotor shaft 6 on the discharge side to be drive to rotate.

The main thrust bearing 11 has an inner ring fixed to the rotor shaft 6, and an outer ring fixed to the casing 2. Meanwhile, the balance bearing 12 has an inner ring fixed to the rotor shaft 6 and an outer ring held by a bearing holding member 13 which is not fixed to the casing 2. Thus, the outer ring is movable in the axial direction relative to the casing 2.

An umbrella shape pressure transmission member 14 covering an axial end of the rotor shaft 6 is fitted to the bearing holding member 13. A wavy spring 15 is provided between the bearing holding member 13 and the casing 2. A front end of the pressure transmission member 14 is inserted into an opening 16 provided in the casing 2 on an extension of the rotor shaft 6 on the suction side, and abutted with a diaphragm 17 for sealing the outer side of the opening 16. A balance cylinder 18 is provided on the outer side of the opening 16, and a balance piston 19 fitted to the balance cylinder 18 can be abutted with the pressure transmission member 14 via the diaphragm 17.

An inner space of the balance cylinder 18 is partitioned into a high pressure fluid chamber 20 on the suction side of the screw rotor 3 (the opposite side of the screw rotor 3 relative to the balance piston 19) and a low pressure fluid chamber 21 on the discharge side (the same side as the screw rotor 3 relative to the balance piston 19) by the balance piston 19. A pressure introduction pipe 22 communicating with the discharge port 5 is connected to the high pressure fluid chamber 20. Similarly, a fluid on the suction side of the screw rotor 3 is introduced into the low pressure fluid chamber 21. Thereby, the balance piston 18 is pushed toward the discharge side along the axial direction of the rotor shaft 6 by differential pressure between discharge pressure and suction pressure of the screw rotor 3, so as to press the pressure transmission member 14 via the diaphragm 17. Thus, the bearing holding member 13 can be pressed toward the discharge side (in the direction from the balance piston 19 toward the screw rotor 3) (fluid pressure application means).

The wavy spring 15 presses the bearing holding member 13 toward the suction side (in the direction from the screw rotor 3 toward the balance piston 19) so that the balance bearing 12 is not damaged by backlash of the outer ring of the bearing even in a state that fluid pressure is not applied on the balance piston 19. However, the pressure thereof is very small and ignorable in connection with discussion of the thrust load applied on the rotor shaft 6.

When a difference between the discharge pressure and the suction pressure is increased in the screw compressor 1, thrust force of pushing the screw rotor 3 toward the suction side is increased. Meanwhile, the fluid pressure of pushing the balance piston 19 is also increased. The balance piston 19 presses the bearing holding member 13 toward the suction side via the pressure transmission member 14, and presses the rotor shaft 6 toward the discharge side via the balance bearing 12. That is, the fluid pressure applied on the balance piston 19 presses the rotor shaft 6 in the direction in which the thrust force generated by fluid compression of the screw rotors 3 is diminished, and reduces loading on the main thrust bearing 11, so that the life of the main thrust bearing 11 is extended.

In the screw compressor 1, the outer ring of the balance bearing 12 is held by the bearing holding member 13 which is movable in the axial direction relative to the casing 2 together with the pressure transmission member 14 and the balance piston 19. Thus, even when a size error or thermal expansion is caused in the rotor shaft 6 or the casing 2, the balance piston 19 is moved in the balance cylinder 18 so as to prevent thrust force from concentrating on either the main thrust bearing 11 or the balance bearing 12. Thus, the thrust force can be distributed onto the main thrust bearing 11 and the balance bearing 12.

In the screw compressor 1, the balance piston 19 for applying the fluid pressure in order to diminish the thrust force generated in the screw rotor 3 is separated from the rotor shaft 6 and not required to rotate. Therefore, the balance piston 19 does not cause rotational resistance, and hence efficiency of the screw compressor 1 is not lowered. In the screw compressor 1, an excessive load is not applied on the main thrust bearing 11 due to leakage of compression gas or sealing oil or no application of the fluid pressure caused by seal deterioration between the balance cylinder 18 and the balance piston 19.

As in the present embodiment, since the discharge pressure of the screw rotors is applied onto the high pressure fluid chamber 20 on the suction side relative to the balance piston 19 and the suction pressure is applied onto the low pressure fluid chamber 21 on the discharge side, even in a case where the suction pressure is high, the thrust force can be properly distributed onto the main thrust bearing 11 and the balance bearing 12 so as to effectively prevent damage of the bearings. Fluid pressure indicating other reference pressure such as charging pressure of cooling, lubricating or sealing oil of the screw rotors 3 may be applied onto the low pressure fluid chamber 21.

The fluid pressure application means of the present invention (the balance piston 19 and the pressure transmission member 14) is completely separated from rotation of the rotor shaft 6. Thus, for example, the balance bearing 12 may be provided on the discharge side of the screw rotor 3, and the balance bearing 12 may be pressed toward the discharge side by a plurality of fluid cylinders arranged around the rotor shaft 6.

It should be noted that in the above embodiment of the present invention, the screw fluid machine of the present invention is applied to the screw compressor. However, the screw fluid machine of the present invention may be applied to a screw expander in addition to the screw compressor.

In a case where the present invention is applied to the screw expander, the substantially same arrangement as the screw compressor described above may be used but the rotational direction of the screw rotors 3 and flow of the fluid are reversed. Therefore, the suction port 4 in the above embodiment serves as a discharge port (an exhaust port) for the screw expander, and the discharge port 5 serves as a suction port (an intake port) for the screw expander. In the screw expander, the fluid is not compressed but expanded so as to rotate the screw rotors 3. Thus, the fluid pressure on the discharge side is lower than the fluid pressure on the suction side. Although an electric motor such as the motor is connected to the rotor shaft 6 in the above screw compressor 1, a loading device such as a generator is connected at a similar position in a case of the screw expander.

The invention claimed is:

1. A screw fluid machine, comprising:

a casing;

at least one screw rotor rotatably accommodated in said casing and adapted to suction, compress or expand, and discharge a fluid, whereby the interior of said casing exhibits a lower pressure side and a higher pressure side;

a main thrust bearing having an inner ring fixed to a rotor shaft, serving as a rotation shaft of said at least one screw rotor, and having an outer ring fixed to said casing, said main thrust bearing being adapted to receive a thrust force of said rotor shaft;

a balance bearing having an inner ring fixed to said rotor shaft and an outer ring movable in the axial direction of the screw rotor relative to said casing;

a bearing holding member holding said outer ring of said balance bearing;

a balance cylinder having therein a balance piston that divides the balance cylinder into a high pressure fluid chamber and a low pressure fluid chamber at opposite sides of said balance piston in the axial direction of the screw rotor;

a pressure transmission member connected for movement with said balance piston and said bearing holding member, whereby movement of the piston in the balance cylinder is transmitted to the outer ring of the balance bearing;

fluid conduits respectively fluidically connecting said high pressure fluid chamber to said higher pressure side of said casing, and said low pressure fluid chamber to said lower pressure side of said casing;

an opening in said casing adjacent the pressure transmission member; and a diaphragm positioned between said balance piston and said pressure transmission member, the diaphragm sealing said opening, wherein the diaphragm is engaged by both said balance piston and said pressure transmission member such that the pressure transmission member and the balance piston are connected for movement via said diaphragm.

2. The screw fluid machine according to claim 1, wherein said screw fluid machine comprises a screw compressor, and said balance bearing is provided on the suction side of said rotor shaft.

3. The screw fluid machine according to claim 1, wherein said screw fluid machine comprises a screw expander, and said balance bearing is provided on the discharge side of said rotor shaft.

4. The screw fluid machine according to claim 1, further comprising a spring urging the bearing holding member away from the main thrust bearing in the axial direction of the screw rotor.

5. The screw fluid machine according to claim 4, wherein said high pressure fluid chamber and said low pressure fluid chamber are arranged such that higher pressure fluid in said high pressure fluid chamber urges the piston to press the outer ring of the balance bearing toward the main thrust bearing in the axial direction of the screw rotor and lower pressure fluid in said low pressure fluid chamber urges the piston to press the outer ring of the balance bearing away from the main thrust bearing in the axial direction of the screw rotor.

* * * * *